US006151737A

United States Patent [19]

Henninge

[11] Patent Number: 6,151,737

[45] Date of Patent: Nov. 28, 2000

[54] BABY CHANGING STATION

[75] Inventor: Paul Henninge, Burlington, Vt.

[73] Assignee: Avmor Ltd., Montreal, Canada

[21] Appl. No.: 09/304,275

[22] Filed: May 6, 1999

[51] Int. Cl.[7] ..... A47C 17/40; A47D 7/00

[52] U.S. Cl. ..... 5/655; 5/947; 5/136

[58] Field of Search ..... 5/136, 133, 655, 5/947, 424; 312/246, 248; 108/38, 42

[56] References Cited

U.S. PATENT DOCUMENTS

| | | | |
|---|---|---|---|
| 5,086,527 | 2/1992 | Takahashi et al. | 5/947 |
| 5,754,999 | 5/1998 | Helmsderfer | 5/947 |
| 5,864,905 | 2/1999 | Helmsderfer | 5/655 |
| 5,906,015 | 5/1999 | Hilger et al. | 5/136 |
| 6,032,310 | 3/2000 | Helmsderfer et al. | 6/655 |

*Primary Examiner*—Alexander Grosz
*Attorney, Agent, or Firm*—Oblon, Spivak, McClelland, Maier & Neustadt, P.C.

[57] ABSTRACT

A baby changing station includes a platform coupled by a hinge to a wall structure. The platform is movable between a closed position and an open position. The interlocking configuration of the hinge and the combination of the geometries of the platform, the wall structure and a wall portion result in a baby changing station which is sturdy and is not susceptible to contamination, given the blow-molded parts. The platform is hollow and includes a trough for receiving a baby when in the open position. The wall structure is smaller than the platform in order to be nested within the platform when in the closed position. The blow-molded hinge configuration eliminates the use of a steel pin or rod generally used in the art to strengthen the hinge. The baby changing station of the present invention provides a secure interface which may be easily cleaned and maintained and is less subject to structural damage. The hinge is further provided with at least one stop, and preferably five, which prevent the platform from rotating beyond the open position.

13 Claims, 7 Drawing Sheets

BABY CHANGING STATION

FIELD OF THE INVENTION

The present invention relates to a baby changing station.

DESCRIPTION OF THE PRIOR ART

A baby changing station is a temporary horizontal working surface for changing the diapers on an infant. Such stations are usually located in public restrooms in order to provide a dedicated space for the changing of a diaper.

A baby changing station usually take the form of a platform which is hinged to a wall in a public restroom. The platform can be swung down to provide a temporary surface on which an infant lies while a parent or supervisor proceeds with the changing of a diaper.

Advantageously, the platform also includes restraint means to hold the infant in place while the diaper is being changed.

The prior baby changing stations have been made of various materials: some have been made of rotationally moulded high density polyethylene; some have been made of blow-moulded high density polyethylene and some have been made of stainless steel. Rotational moulding is costly due to long cycle times to make the various parts, but offers strength to a station, particularly in the comers and the hinge area. However, rotationally moulded parts can be porous and pitted with small holes, resulting in an unsanitary product since dirt and other contaminants may enter these holes. Blowmoulded parts are of a higher quality, but are usually of a poor design, resulting in that these blow-moulded parts require additional structural steel plates to strengthen the areas around the wall and the hinges. The designs of the plastic parts require that separate metal parts at the hinge or reinforced near the hinge be present to provide additional strength and safety. These structural additions are merely added to assist a poor plastic design since any point beyond or at the edge of these metal parts is plastic again. The addition of both metal plates and/or steel hinge rods for the hinge require the plastic parts to be drilled, routed or cut open, exposing these parts to bacteria and dirt even though they are routinely cleaned. The addition of these steel components also add an additional cost which offsets the manufacturing efficiencies of using the blow moulding process.

Finally, some baby stations have been proposed where the outer shell is made of stainless steel. Although stainless steel has the advantage of being easy to clean, sturdy and can be aesthetically pleasing, such baby stations are too expensive for large-scale deployment. Furthermore, due to the weight of stainless steel, the hinges for the platform must be somehow counterbalanced so that pivoting down and up of the platform is relatively easy, which increases the complexity of such a station, and consequently its cost. Such a baby station is described in U.S. Pat. No. 5,754,999.

Many existing baby changing stations are simply a rectangular "brief-case" mounted to the wall and present unsafe working conditions while changing a baby's diaper. Objects like clean-wipes, cigarettes and bottles or other containers, to name a few items, can be placed on top of the station against the wall so that then the station is used, the items can fall, thereby creating a dangerous situation for the infant.

In terms of regulatory requirements, some jurisdictions such as the United States (through the Americans with Disabilities Act) require that objects projecting from walls in public restrooms do so by no more than four inches (or approximately ten centimeters).

Another drawback of existing baby changing stations is the fact that the bed lining towels (which are placed on the platform prior to placing the infant thereon) are dispensed from an unlocked dispenser which allows the public to take the towels and use them for other purposes than their intended use, contaminate the dispensing area or use the unlocked dispenser as a refuse depository for used diapers.

Over and above the previous comments, baby changing stations must maintain a secure horizontal working surface with as little flexibility as possible so that the infant rests safely and securely while being changed. This surface must be quite strong to allow safe support even if an adult may slip and use the baby changing station as a support while the infant rests within the platform.

Furthermore, the shape of the horizontal baby station should be best suited for the anthropometrics of infants up to two years old and also allow a good ergonomic work environment for the person changing the diaper. Providing an efficient geometry to work around is especially important when the table is retrofit into an existing environment where there may not have been room to install a baby changing station previously.

SUMMARY OF THE INVENTION

It is thus an object of the invention to provide a baby changing station that is safe, solid, economical to manufacture, efficient and clean. The baby changing station of the invention provides a sanitary structure with parts that are sealed from outside environmental contamination without the need for additional steel reinforcements and/or steel pins for the hinge. The baby station is further constructed to prohibit unwanted items from being left on top of the station and inadvertently cause harm to the infant, parent or guardian or to the station itself. Furthermore, the baby changing station according to the invention fits within the current regulatory environment.

In accordance with the invention, these objects are achieved with a baby diaper changing station comprising a wall structure having a top, a bottom and two opposite sides, adapted to be mounted to a wall and a platform being connected by hinge means to the wall structure and being movable between an open and closed position, the platform having a trough for receiving a baby when in the open position. The platform has a top, a bottom and two opposite sides.

The hinge means include concave feet projecting from the bottom of the wall structure on both sides thereof respectively. The platform is provided with a generally cylindrical portion, the cylindrical portion having a predetermined length and being located between the opposite sides of the platform at the bottom thereof. Slots are provided on said platform in registration with each of the feet for receiving them. The hinge means further include a wall portion having convex feet projecting from the bottom thereof on both sides respectively. Means are provided for securing the wall structure and the wall portion together, in order to define an opening between each of the concave and convex feet into which the cylindrical portion is housed and for permitting the cylindrical portion to rotate therein, while preventing the platform from escaping the opening. The hinge means further include at least one stop for preventing the platform from rotating beyond the open position.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF A PREFERRED EMBODIMENT OF THE INVENTION

The baby changing station according to the invention is illustrated in FIGS. 1–7.

Figure 1:
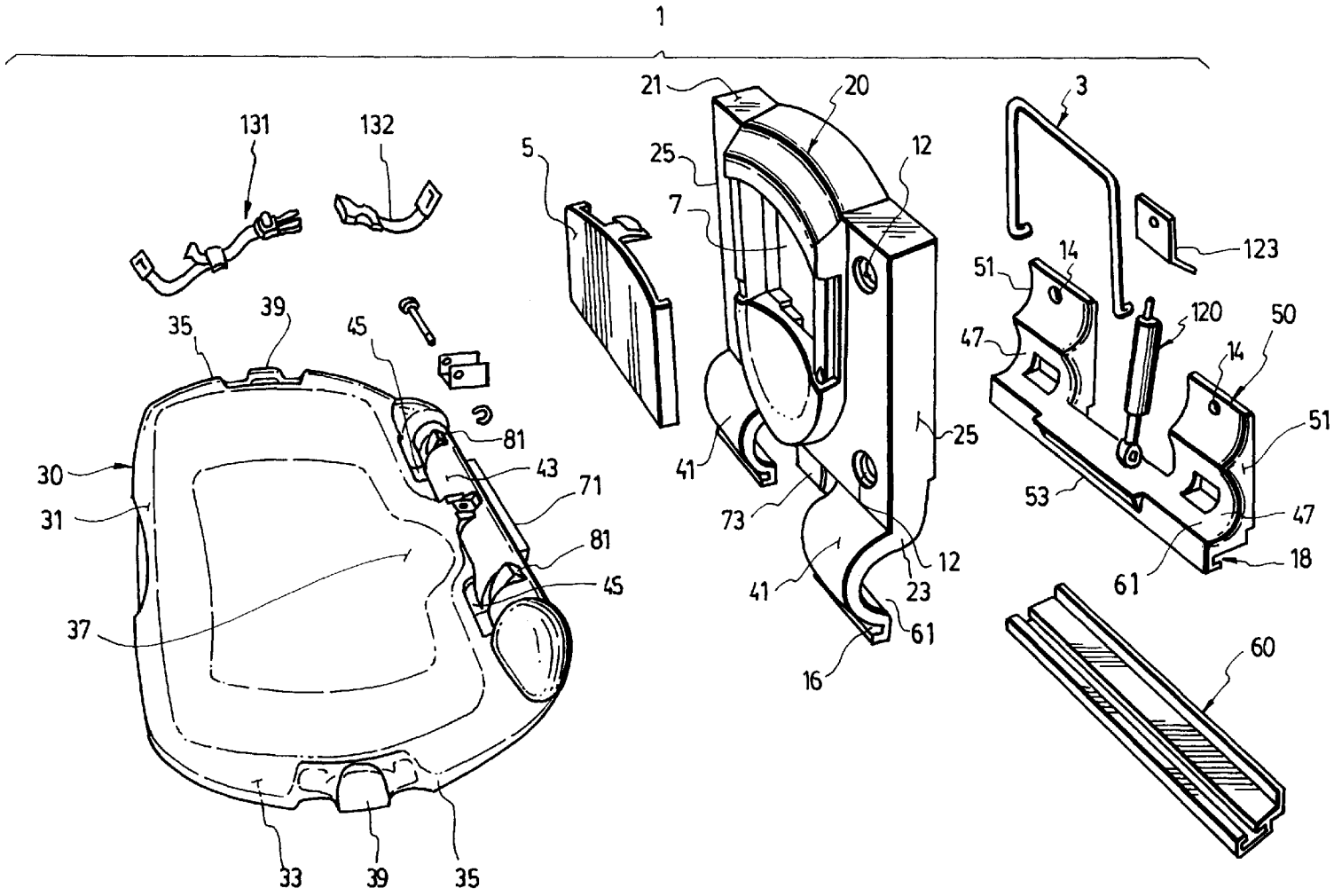
FIG. 1 is an exploded perspective view of a baby changing station according to a preferred embodiment of the invention.

Referring now to FIG. 1, the baby changing station comprises two major components: a wall structure 20 adapted to be mounted to a wall and having a top 21, a bottom 23 and two opposite sides 25; and a platform 30 having a top 31, a bottom 33 and two opposite sides 35. The platform is connected by hinge means to the wall structure 20 and is movable between an open position (see FIG. 1) and a closed position (see FIG. 2). The platform has a trough 37 for receiving a baby when the platform is in the open position.

The wall structure 20 mounts to a wall through mounting points 12. The wall structure preferably has a relatively small top 21 and a curved profile (as better shown in FIG. 1), so that items cannot be placed on top of it. This is advantageous, since items placed on the top of a baby changing station can sometimes fall and injure a baby placed on the platform 30.

An important aspect of the invention lies in the hinge means for connecting the platform 30 to the wall structure 20. In accordance with the invention, the hinge means include concave feet 41 projecting from the bottom of the wall structure 20 on both sides 25 thereof respectively (see FIGS. 1, 2 and 3). The hinge means also include a generally cylindrical portion 43 on the platform 30, the cylindrical portion 43 having a predetermined length and being located between the opposite sides 35 of the platform 30 at the bottom 33 thereof. Slots 45 are provided in the platform. The slots 45 are in registration with each of the feet 41 proximate the cylindrical portion 43, and are designed to receive the feet 41, as better shown in FIGS. 2 and 3. The hinge means also include a wall portion 50 secured to the wall structure 20. The wall portion includes convex feet 47 projecting from the bottom 53 of the wall portion, on both sides 51 thereof respectively.

The two lowermost mounting points 12 are in registration with mounting points 14, and the resulting structure is then sandwiched together. As mentioned above, the wall structure 20 and the wall portion 50 are secured together, thereby defining an opening 61 between each of the concave 41 and convex 47 feet into which the cylindrical portion 43 is housed. This permits the cylindrical portion 43 to rotate within the opening 61, while preventing the cylindrical portion 43, and thereby the platform 30, from escaping the opening 61. The bottom of the resulting structure is held together with an extruded clip form 60, which is profiled to espouse the shapes 16, 18 of the bottom of the feet 41 of the wall structure 20 and the bottom of the wall portion 50 (see FIG. 1).

When the platform 30, the wall structure 20 and the wall portion 50 are fastened together, an overall rigid structure results, which structure is not typically possible as a blow-molded part.

Since it is an essential requirement of a baby station that it be sturdy, the hinge means are also provided with at least one stop, for preventing the platform 30 to rotate beyond the open position. In accordance with the invention, the hinge means preferably include five such stops, each of which will be detailed hereinafter.

The first stop consists of a longitudinal flange 71 along the cylindrical portion 43 and between each of the slots 45. The longitudinal flange projects downwardly when the platform is in the closed position. Cooperating with the flange 71 is a ledge 73 located on the wall structure 20 and between each of the feet 41. When the platform 30 is in the open position, the flange 71 contacts the ledge 73 and the platform is thereby prevented from rotating beyond the open position, as better shown in FIG. 6.

Figure 4:
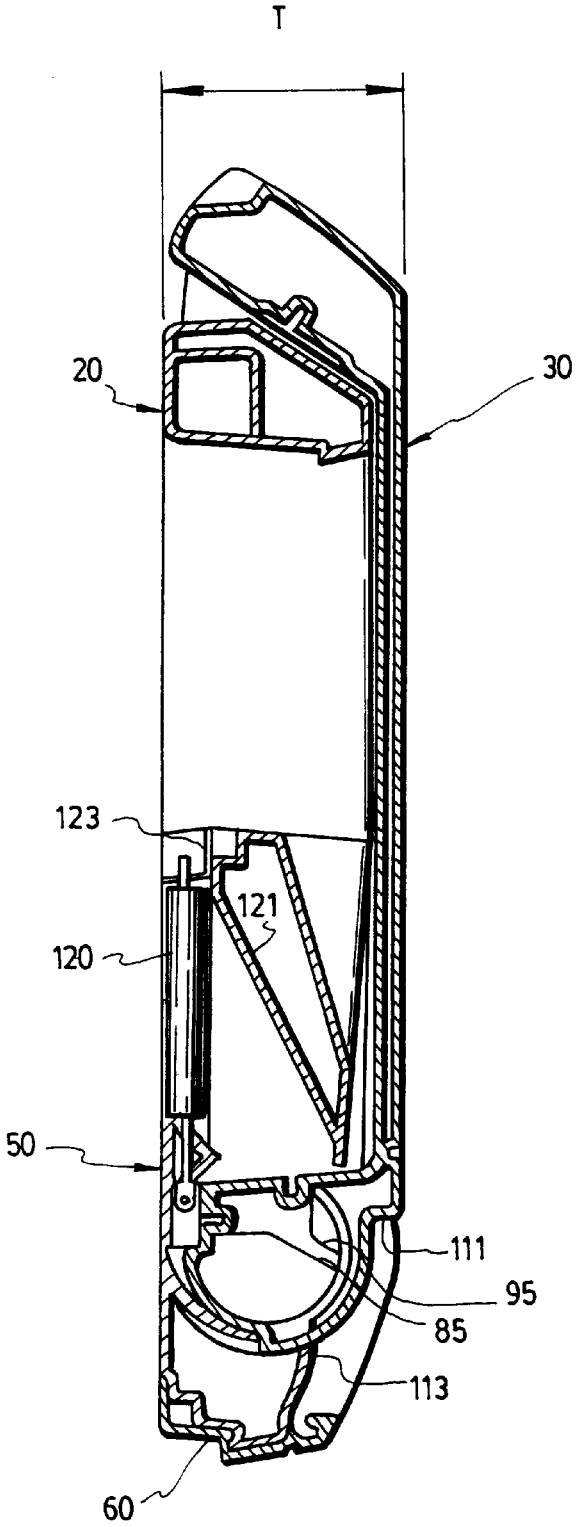
FIG. 4 is a side plan view of the baby changing station of FIG. 1 in closed position.
Figure 5:
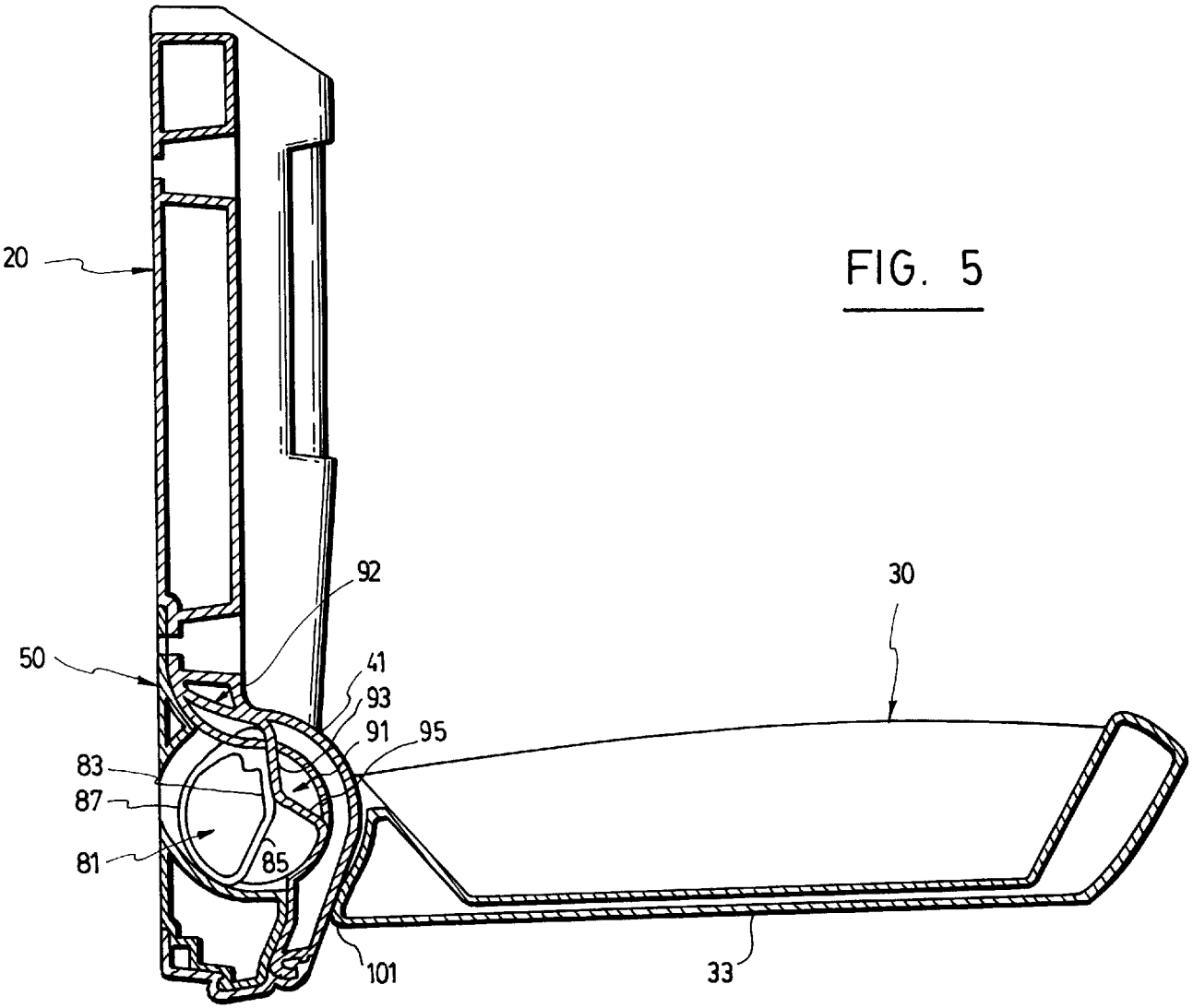
FIG. 5 is a side plan view of the baby changing station of FIG. 1 in open position but not showing a pneumatic strut.

The second stop consists of a female portion 81, partially shown in FIG. 1, within the cylindrical portion 43 at the location of the slots 45. The female portion has a generally triangular cross-section, a first edge 83, a second edge 85 and a generally rounded back 87, as illustrated in FIGS. 4, 5, 6 and 7, but where the reference numerals are more specifically shown in FIG. 5. The second stop also includes a male portion 91 projecting out of each of the feet 41 and cooperating with the female portion 81. The male portion 91 has a generally triangular cross-section, a first edge 93 and a second edge 95. As shown in FIG. 5, when the platform 30 is in the open position, the first edge 83 of the female portion 81 contacts the first edge 93 of the male portion 91 and is thereby prevented from rotating beyond the open position by the first edge 93 of the male portion. Referring now to FIG. 4, when the platform 30 is in the closed position, the second edge 85 of the female portion 81 is in close proximity, or directly contacts, the second edge 95 of the male portion 91. It should be noted that this structure is further reinforced since the male portion 91 has a direct tensile geometric relationship (see arrow 92 on FIG. 5) to the lower mounting points 12.

The third stop consists of an edge 101 (see FIG. 5), defined by the slot 45 on the bottom surface 33 of the platform 30. When the platform is in the open position, the edge 101 rests against an outer surface of the feet 41, thereby preventing the platform from rotating beyond the open position.

The fourth stop includes another longitudinal flange 111 (see FIG. 4) on the platform 30 on the bottom surface thereof. A corresponding ledge 113 is provided on the means for securing the wall structure 20 and the wall portion 50 together. When the platform 30 is in the open position, the other flange 111 contacts the corresponding ledge 113 on the means for securing the wall structure 20 and the wall portion 50 together, thereby preventing the platform 30 from rotating beyond the open position. Preferably, the other flange 111 is designed into the extruded clip form 60.

Figure 6:
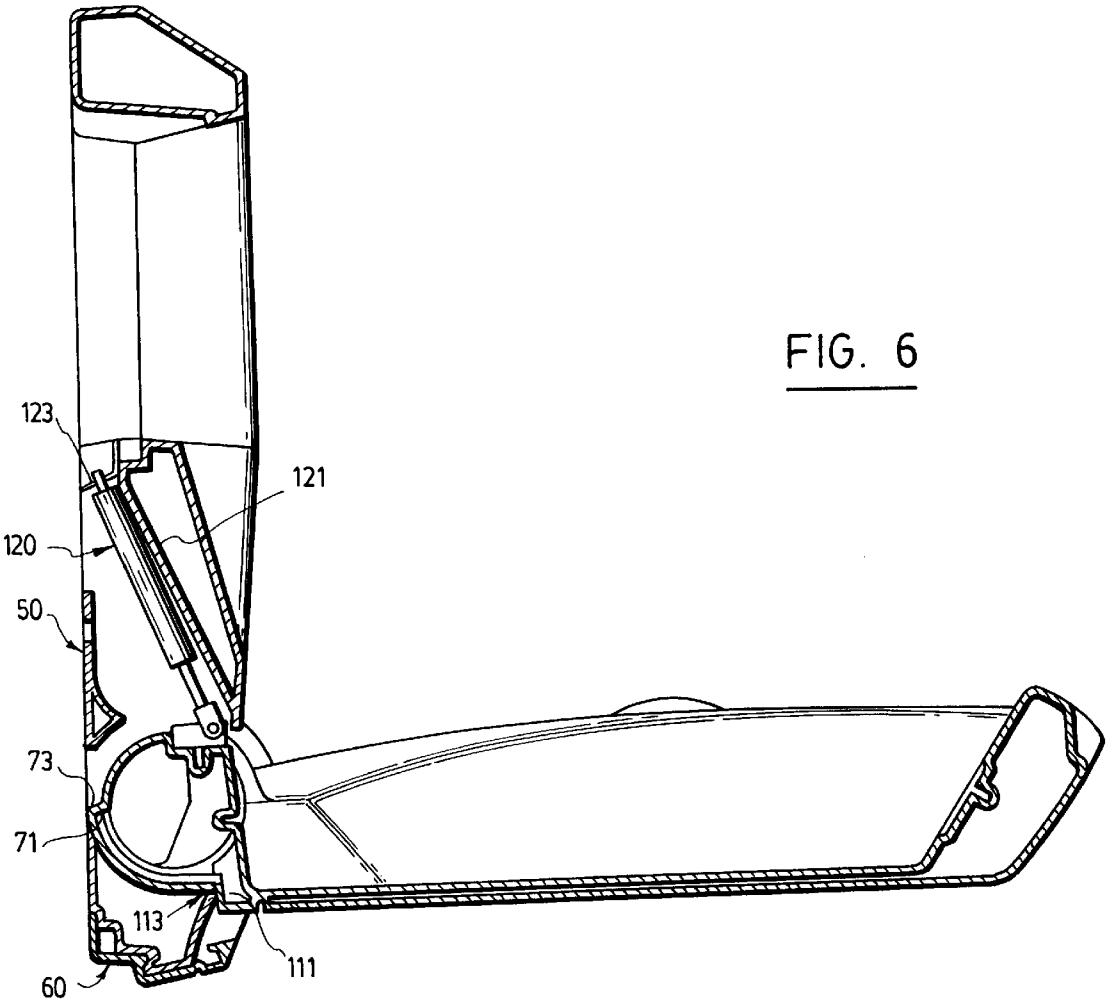
FIG. 6 is a side plan view showing the pneumatic strut.
Figure 7:
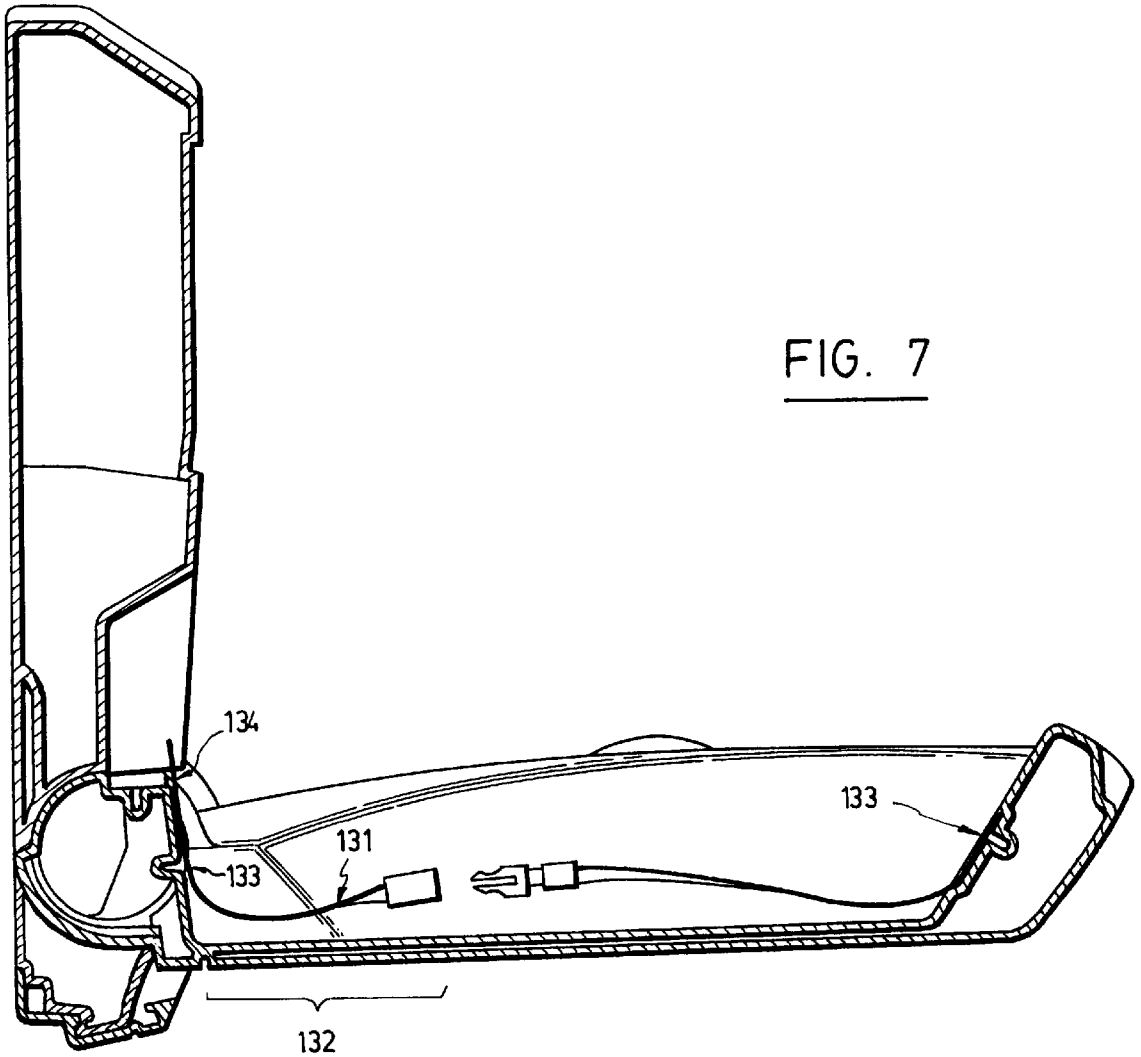
FIG. 7 is a side plan view of the baby changing station of FIG. 1, showing the safety straps.

The fifth stop includes a pneumatic strut 120 operatively connected between the wall structure 20 and the platform 30 approximately in the respective centers thereof (see FIGS. 1, 4 and 6). Preferably, the wall structure 20 has an interior 121 angled portion. When the platform 30 is in the closed position, the pneumatic strut 120 is constricted and substantially vertical (see FIG. 4). When the platform 30 is in the open position, the pneumatic strut is extended and at an angle. Preferably, the angle at which the pneumatic strut is at conforms generally to the angled portion 121 of the wall structure 20, so that the interior wall portion 121 interferes with the pneumatic strut, thereby preventing rotation of the platform 30 beyond the open position. Preferably, the pneumatic strut is fastened to the wall structure 20 through a clip 123.

As can be seen, the platform 30 has as little flexibility as possible due to the fact that there are preferably five stops within the geometry of the hinge to prevent the platform from rotating beyond the open position. As detailed above, the most critical stops are encapsulated within the sockets of the hinge geometry and have a direct tensile connection to the lower set of holes 12.

In addition, the baby changing station 1 is further preferably provided with a towel cover 5 which covers area 7. Area 7 is a hollow section of the wall structure 20 with no back being punched out of the blow-molded structure 20. This allows the wall structure 20 to hold standard bed liners and towel wipes, while also enabling the wall structure 20 to nest within the platform 30 when the latter is in the closed position. This also has the added advantage that the baby changing station 1, when closed, is ADA compliant, i.e. it has a thickness T which is less than four inches.

Advantageously, a retractable wire form 3 can also be provided, permitting the use of smaller standard towel types to be used in the towel area 7.

The towel area 7 is secure from public tampering by preferably having a locking feature which can only be used by a service person. The area 7 for the bed towels is not easily subject to contamination of bacteria or other environmental dirt because of the blow-molded construction and fully sealed integration.

In order to properly secure a baby on the platform, the platform 30 is provided with a locking strap 131. The locking strap 131 is preferably made of two pieces (see FIGS. 1, 3 and 7), and has a piece 132 which is thicker, so that the platform may be placed in the closed position without the strap 131 obstructing the hinge. The safety strap 131 is connected as close to the floor of the platform 30 as possible so that a baby placed thereon is well secured (see numeral 133 on FIG. 7). Preferably, the strap 131 penetrates into the hinge area at 134 to obstruct the mechanism from the outside. This allows the strap to run into the pneumatic strut area, which is a safety feature to insure that small fingers may not be able to enter the hinge area.

Advantageously, the platform is further provided with utility hooks 39 on each opposite side of the platform 30, so that users may hang items such as bags or purses on these hooks 39 instead of placing them on the floor. Since the baby changing station 1 includes at least one stop, the construction is solid enough that placing such items on the hooks will not break the hinge.

Figure 2:
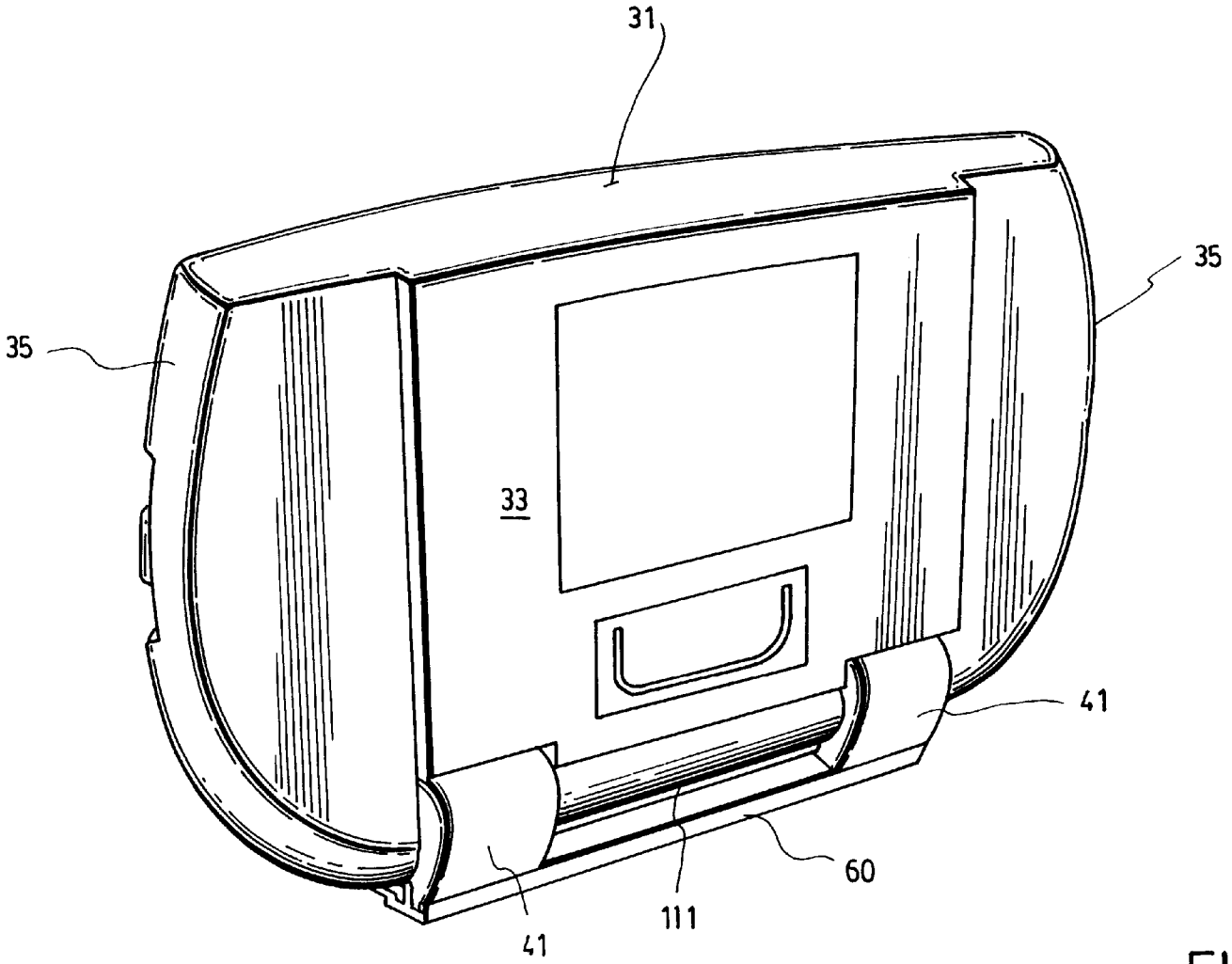
FIG. 2 is a perspective view of the baby changing station of FIG. 1 in closed position.
Figure 3:
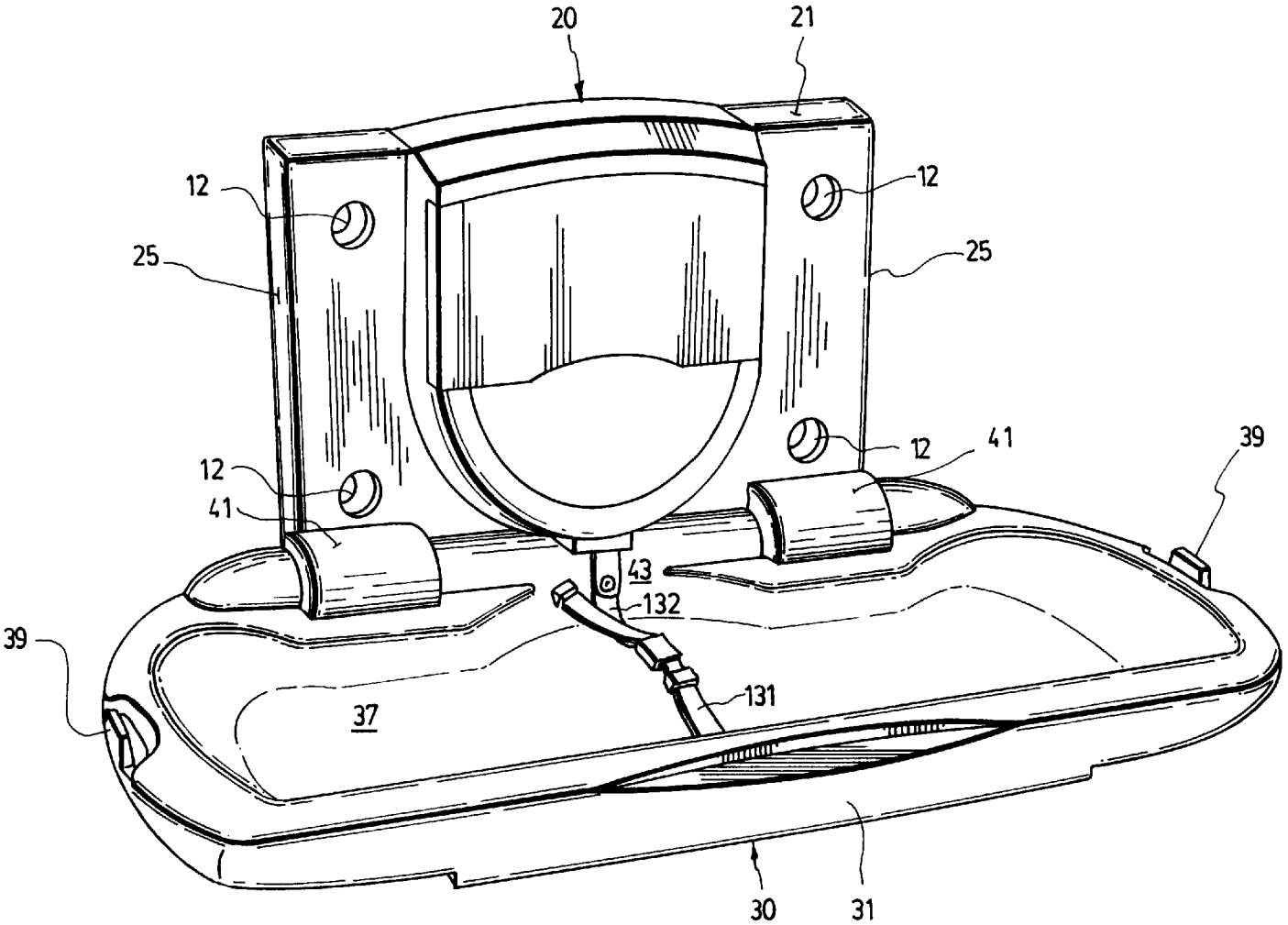
FIG. 3 is a perspective view of the baby changing station of FIG. 1 in open position.

Referring now to FIG. 2, it can be seen that the platform 30 is angled when closed, in order to prevent items from being placed on top of the platform when in the closed position. This is also a safety feature, since other baby changing stations are not so configured, and items placed thereon may fall due to vibrations and injure a person.

The blow-molded construction of the platform 30, the wall structure 20 and the wall portion 50 allows the distinct advantage of having high quality parts which are sealed from environmental contamination (see FIGS. 1 and 2), and which do not require additional steel reinforcements or steel pins for the hinge. The baby changing station is further constructed in such a way as to prohibit items from being left on top of the station 1 either in the closed or the open position, which could otherwise inadvertently cause harm to the infant, the parent or to the baby changing station 1 itself.

The shape of the baby changing station of the invention is optimally suited for the anthropometrics of infants up to two years of age and also allows a good ergonomic work environment for a user due to the fact that there are no sharp comers at the outer perimeter. Providing an efficient geometry for a user to work around is especially important when the baby changing station of the invention is retrofit into an existing environment where there may not have been enough room previously to install a baby changing station.

Although the present invention has been explained hereinabove by way of a preferred embodiment thereof, it should be pointed out that any modifications to this preferred embodiment within the scope of the appended claims is not deemed to alter or change the nature and scope of the present invention.

What is claimed is:

1. A baby changing station comprising:

a wall structure adapted to be mounted to a wall, said wall structure having a top, a bottom and two opposite sides; and a platform having a top, a bottom and two opposite sides, said platform being connected by hinge means to said wall structure and being movable between an open position and a closed position, said platform having a trough for receiving a baby when in said open position; characterized in that said hinge means include:

concave feet projecting from the bottom of said wall structure on both sides thereof respectively;

a generally cylindrical portion on said platform, said cylindrical portion having a predetermined length and being located between said opposite sides of said platform and at the bottom thereof, slots in the platform in registration with each of said feet proximate said cylindrical portion for receiving said feet;

convex feet projecting from a bottom of a wall portion on both sides thereof respectively;

means for securing said wall structure and said wall portion together, for defining an opening between each of said concave and convex feet into which said cylindrical portion is housed and for permitting said cylindrical portion to rotate therein, while preventing said platform from escaping said opening; and at least one stop for preventing said platform to rotate beyond said open position.

2. A baby changing station according to claim 1, wherein:

said at least one stop includes a first stop, said first stop comprising a longitudinal flange along said cylindrical portion and between each of said slots; and a ledge on said wall structure located between each of said feet, whereby when said platform is in said open position, said flange contacts said ledge and is prevented from rotating beyond said ledge.

3. A baby changing station according to claim 2, wherein:

said at least one stop includes a second stop, said second stop comprising:

a female portion within said cylindrical portion at the location of said slots having a generally triangular cross-section, said female portion having a first edge and a second edge and a rounded back;

a male portion projecting out of each of said feet and cooperating with said female portion within said cylindrical portion, said male portion of said feet having a generally triangular cross-section, a first edge and a second edge;

whereby, when said platform is in said open position, said first edge of said female portion contacts said first edge of said male portion and is prevented from rotating beyond said open position by said first edge of said male portion, and when said platform is in said closed position, said second edge of said female portion contacts said second edge of said male portion.

4. A baby-changing station according to claim 3, wherein:

said at least one stop includes a third stop, said third stop including an edge defined by said slot on said bottom surface of said platform, whereby when said platform is in said open position, said edge rests against an outer surface of said feet, thereby preventing said platform from rotating beyond said open position.

5. A baby changing station according to claim 4, wherein:

said at least one stop includes a fourth stop, said fourth stop including a another longitudinal flange on said platform on said bottom surface thereof, and a corresponding ledge on said means for securing said wall structure and said wall portion together, whereby when said platform is in said open position, said other flange contacts said corresponding ledge on said means for securing said wall structure and said wall portion together, thereby preventing said platform from rotating beyond said open position.

6. A baby changing station according to claim 5, wherein said means for securing said wall structure and said wall portion together is an extruded clip form.

7. A baby changing station according to claim 5, wherein said at least one stop includes a fifth stop, said fifth stop including a pneumatic strut operatively connected between said wall structure and said platform approximately in the respective centers thereof, and said wall structure has an interior, angled portion, whereby, when said platform is in said closed position, said pneumatic strut is substantially vertical, and when said platform is in said open position, said pneumatic strut is at an angle, said angle conforming generally to said angled portion of said interior wall portion so that when said platform is in said open position, said interior wall portion interferes with said pneumatic strut thereby preventing rotation of said platform beyond said open position.

8. A baby changing station according to claim 1, wherein said baby changing station is made of blow-moldable plastic.

9. A baby changing station according to claim 1, wherein said top of said platform has a curved profile.

10. A baby changing station according to claim 1, wherein said platform, on each of said opposite sides, is provided with utility hooks.

11. A baby changing station according to claim 1, wherein said top of said wall structure has a curved profile.

12. A baby changing station according to claim 1, wherein said platform is further provided with a safety strap, said safety strap being secured near said top and said bottom of said platform and close to said trough.

13. A baby changing station according to claim 1, wherein when said platform is in said closed position, said wall structure is nested within said platform.

* * * * *